US011673244B2

(12) United States Patent
Tsai et al.

(10) Patent No.: US 11,673,244 B2
(45) Date of Patent: Jun. 13, 2023

(54) OIL FILTER WRENCH

(71) Applicant: STANLEY BLACK & DECKER MEA FZE, Dubai (AE)

(72) Inventors: Yu-Wei Tsai, Taichung (TW); Wan-Chiang Wang, Taichung (TW)

(73) Assignee: STANLEY BLACK & DECKER MEA FZE, Dubai (AE)

( * ) Notice: Subject to any disclaimer, the term of this patent is extended or adjusted under 35 U.S.C. 154(b) by 214 days.

(21) Appl. No.: 17/246,205

(22) Filed: Apr. 30, 2021

(65) Prior Publication Data

US 2021/0339366 A1 Nov. 4, 2021

(30) Foreign Application Priority Data

Apr. 29, 2020 (EP) ..... 20172031

(51) Int. Cl.
*B25B 27/00* (2006.01)
*B25B 13/50* (2006.01)

(52) U.S. Cl.
CPC ..... *B25B 27/0042* (2013.01); *B25B 13/5008* (2013.01)

(58) Field of Classification Search
None
See application file for complete search history.

(56) References Cited

U.S. PATENT DOCUMENTS 9,403,263 B2 8/2016 Lai
2012/0079919 A1* 4/2012 Chen ..... B25B 13/44 81/90.2
2016/0114469 A1 4/2016 Lai
2016/0303719 A1* 10/2016 Klamm ..... B25B 27/0042

FOREIGN PATENT DOCUMENTS

CN 104227640 A 12/2014

OTHER PUBLICATIONS

Extended European Search Report for EP Application No. 20172031.5 dated Nov. 3, 2020, 5 pages.

* cited by examiner

*Primary Examiner* — Brian D Keller
(74) *Attorney, Agent, or Firm* — Caeden Drayton

(57) ABSTRACT

An oil filter wrench having a base, a main gear, a plurality of claws each having a gear portion and an arm configured to engage an oil filter. The gear portions are rotatably disposed within the base and configured to engage the main gear such that when the main gear rotates; the arms correspondingly extend or contract relative to the base. The oil filter wrench also includes a main spring. The main spring is disposed within a cavity defined by the main gear. The main spring is configured to selectively bias the main gear toward rotation in either a first direction or a second direction opposite to the first direction. The oil filter wrench is characterised in that it also includes a switching mechanism a switching mechanism. The switching mechanism is configured to selectively toggle between a first position and a second position. In the first position, the switching mechanism engages a first tine of the main spring such that the main gear is biased to rotate in the first direction. In the second position, the switching mechanism engages a second tine of the main spring such that the main gear is biased to rotate in the second direction. The switching mechanism is toggled between the first and second positions by respectively engaging a first pin or a second pin that is integrated into one of the plurality of claws.

17 Claims, 9 Drawing Sheets

OIL FILTER WRENCH

This patent application claims priority to EP20172031.5, filed Apr. 29, 2020, which is hereby incorporated by reference in its entirety.

BACKGROUND OF THE INVENTION

Field of the Invention

The present invention relates to a wrench, and more particularly to an oil filter wrench.

Description of the Prior Art

Internal combustion engines, which power many of the world's vehicles, rely on mechanisms that require oil for lubrication. As these mechanisms operate, the lubricating oil may become fouled due to particulates, such as metal chips, that gets suspended therein. These particulates have the potential to seriously damage the mechanisms of an internal combustion, which may lead to operational inefficiencies up to and including failure of the engine. Oil filters are frequently used to clean the lubricating oil and protect against said inefficiencies and failures. Over time, these filters themselves become fouled and need to be replaced.

It is not uncommon for oil filters to be disposed deep within an engine bay. Positioned as such, it may be difficult to for an operator to reach said oil filter and replace the same. Oil filter wrenches are known tools for facilitating said replacement of oil filters. Oil filter wrenches may be of a band type, which include a handle and a circular band configured to engage the oil filter. Another type is the claw type oil filter wrench. The claw type oil filter wrench may include a base, a gear mechanism and a plurality of arms. In operation, a mechanic may use a removable handle with a socket to engage the gear mechanism allowing the arms of the claw type oil filter to engage the oil filter ad facilitate its removal/replacement. Claw type oil filters have the advantage over their band counterparts in that they are typically smaller and can fit into tighter spaces. However, controlling the gear mechanism, toggling direction for tightening/loosening an oil filter and positioning a claw type filter all with one hand may be cumbersome if not impossible.

The present invention addresses one or more of the aforementioned drawbacks.

SUMMARY OF THE INVENTION

In one aspect, disclosed is an oil filter wrench having a base with an axis. Also included is a main gear centered on the axis and rotatably disposed within the base, and wherein said main gear further includes a drive portion accessible from outside the base. The oil filter wrench also includes a plurality of claws each having a gear portion and an arm configured to engage an oil filter. The gear portions are rotatably disposed within the base and configured to engage the main gear such that when the main gear rotates; the arms correspondingly extend or contract relative to the base. The oil filter wrench also includes a main spring. The main spring is disposed within a cavity defined by the main gear. The main spring is configured to selectively bias the main gear toward rotation in either a first direction or a second direction opposite to the first direction. The oil filter wrench is characterised in that it also includes a switching mechanism a switching mechanism. The switching mechanism is configured to selectively toggle between a first position and a second position. In the first position, the switching mechanism engages a first tine of the main spring such that the main gear is biased to rotate in the first direction. In the second position, the switching mechanism engages a second tine of the main spring such that the main gear is biased to rotate in the second direction. The switching mechanism is toggled between the first and second positions by respectively engaging a first pin or a second pin that is integrated into one of the plurality of claws.

Figure 7:
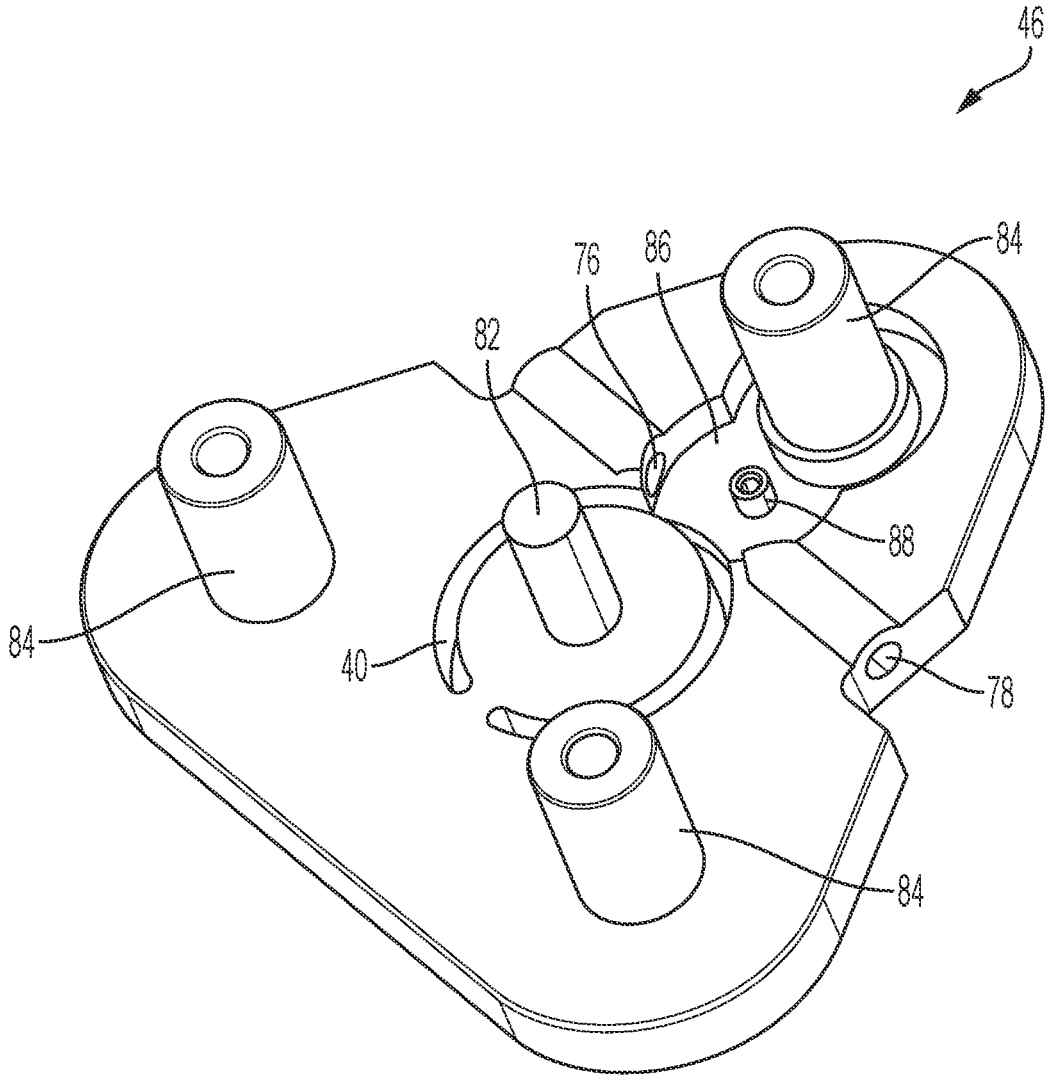
Figure 8:
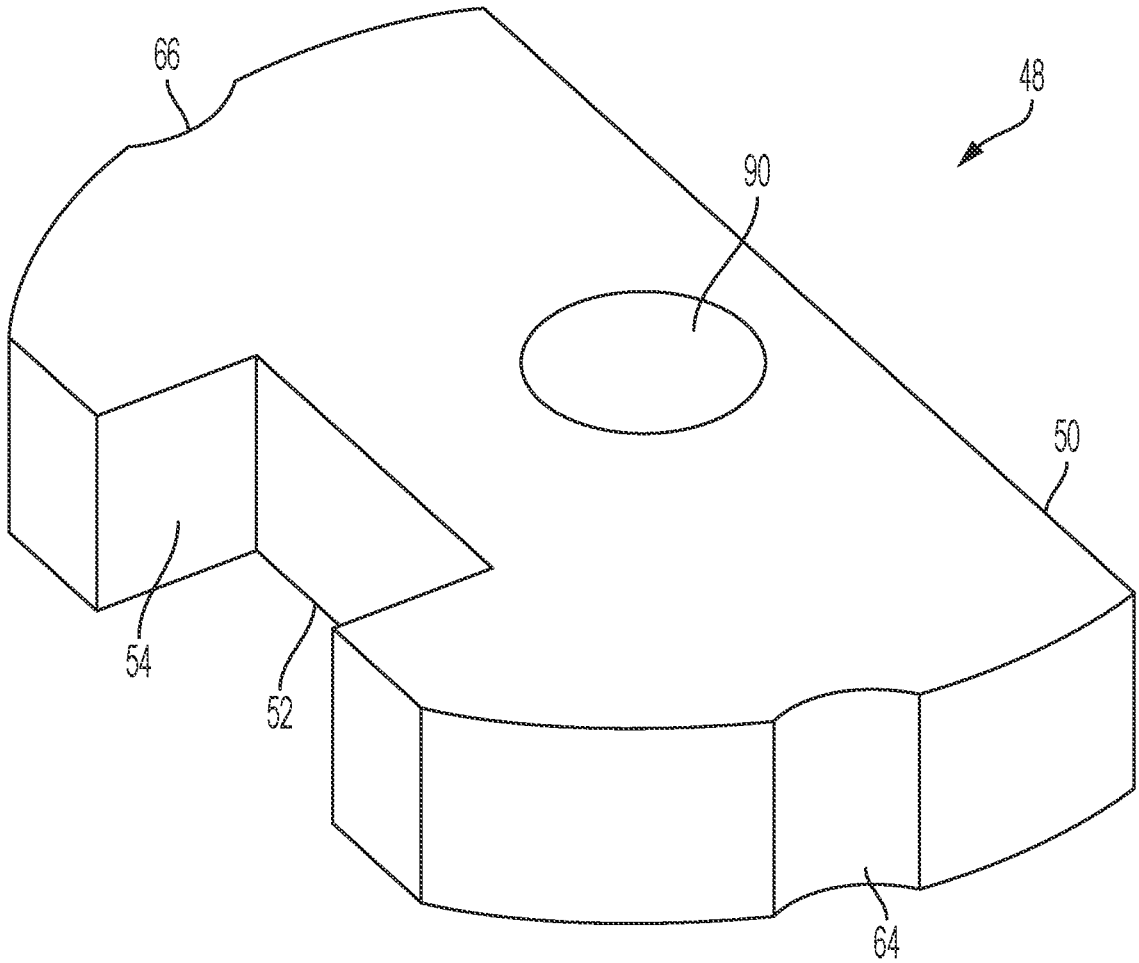

FIGS. **6*a*-6*e*** are a series of views internal gears/switching mechanism and showing the operation of the same;

FIG. 7 is a detailed perspective view of a part of the base;

FIG. 8 is a detailed perspective view of the switch; and

Figure 9:
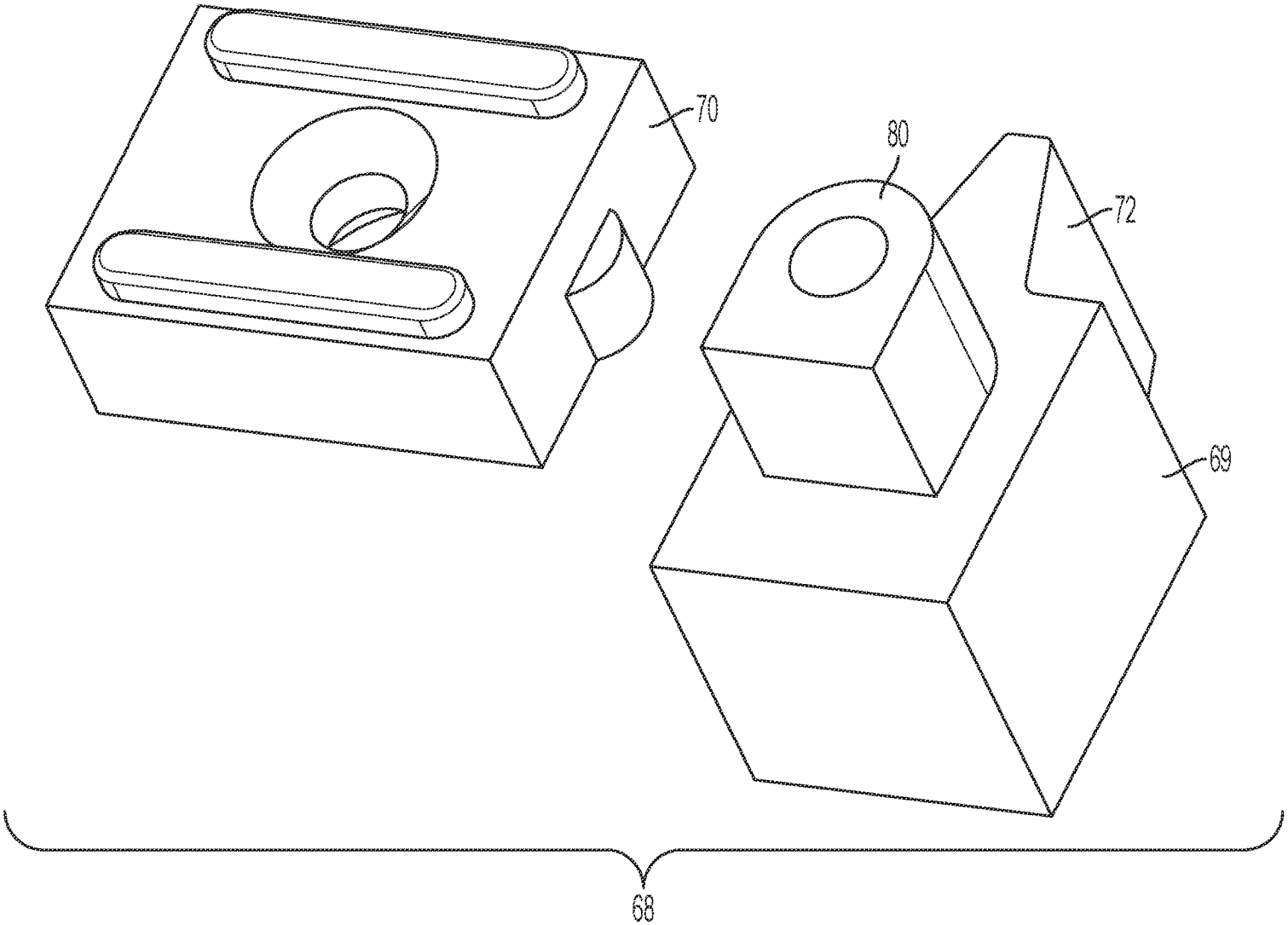

FIG. 9 is a detailed perspective view of the holding mechanism.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
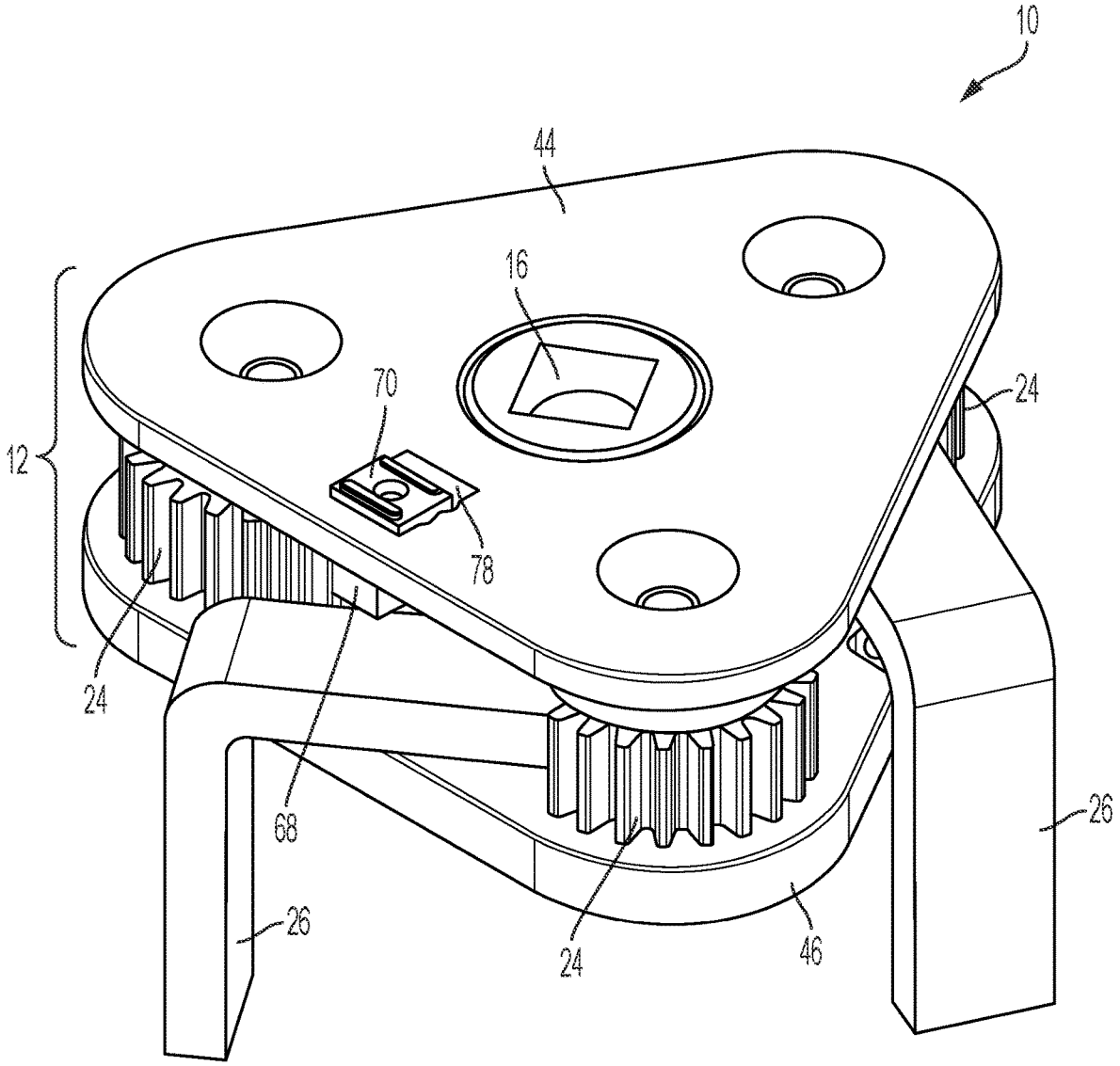
FIG. 1 is a perspective view of the oil filter wrench of the present invention.
Figure 2:
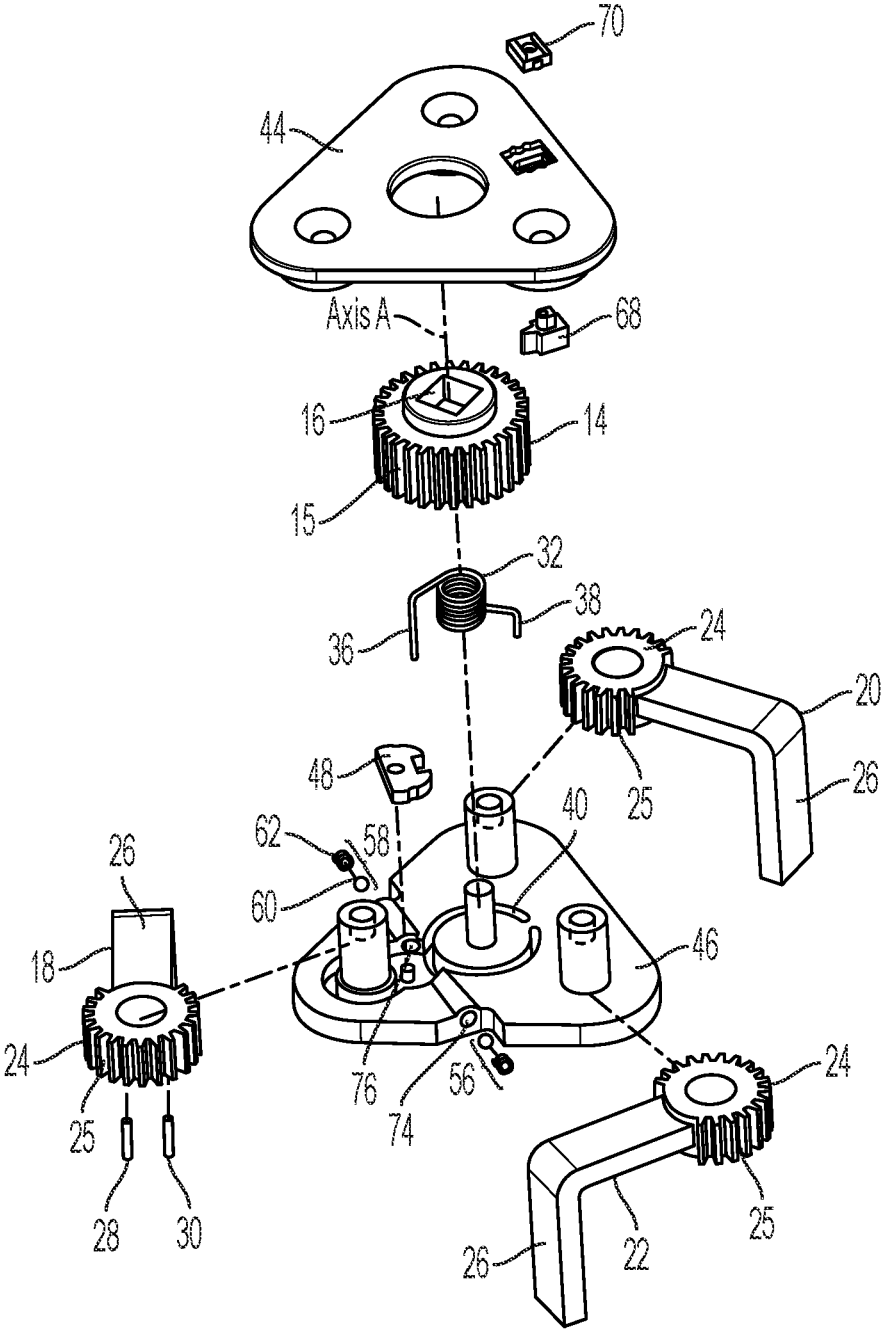
FIG. 2 is an exploded view of the oil filter wrench of the present invention.

As shown in FIGS. 1-2, the oil filter wrench 10 of the present invention includes a base 12 having an axis A. In a preferred embodiment, the base 12 is comprised of a first platform 44 and second platform 46. As will be discussed herein, the first and second platforms 44, 46 may include a variety of protrusions and cavities configured to receive and facilitate the motion of various elements of the oil filter wrench 10.

A main gear 14 rotatably disposed within the base 12 and is centered on axis A. More specifically, the main gear 14 is disposed on a main gear protrusion 82 of second platform 46, which guides and facilitates rotational movement of the main gear 14. The main gear 14 includes a plurality of teeth 15 on its periphery. The main gear also includes a drive portion 16 that is accessible from outside the base 12. The drive portion 16 may be configured to receive a tool that will allow an operator to impart rotational torque to the main gear.

The oil filter wrench also includes a plurality of claws that are disposed within the base 12. More specifically, the claws are disposed on claw protrusions 84 of second platform 46, which guide and facilitate the rotational movement of the claws. As shown in the figures, a preferred embodiment includes three claws 18, 20, 22. Each claw incudes a gear portion 24 and an arm portion 26 that is configured to engage an oil filter (not shown). The gear portions 24 of each claw are rotatably disposed within the base 12. The gear portions 24 also include a plurality of teeth 25 positioned around its periphery. The teeth 25 of the gear portions 24 configured to engage the teeth 15 of the main gear 14 such that when the main gear rotates, the arms 26 of each claw correspondingly extend or contract relative to the base 12. Preferably, the arms 26 are L-shaped. Although the preferred embodiment includes three claws 18, 20, 22, those skilled in the art will recognize that the plurality of claws may be any number of claws greater than one.

The oil filter wrench 10 also includes a main spring 32. The main spring 32 is may be a coil spring that is disposed within a cavity 34 that is defined by the main gear 14. The main spring 32 is configured to bias the rotation of the main gear 14 toward a first direction or a second direction opposite from the first direction. Those skilled in the art will recognize that the first direction may be clockwise (CW) and the second direction may be counterclockwise (CCW), or vice versa.

The oil filter wrench 10 of the present invention also includes a switching mechanism 42 that is configured to toggle between a first position and a second position. In the first position, the switching mechanism 42 engages a first tine 36 of the main spring 32 such that the main gear 14 is biased to rotate in the first direction. Conversely, when the switching mechanism 42 is in the second position, the switching mechanism 42 engages a second tine 38 of the main spring 32 such that the main gear is biased to rotate in the second direction. In a preferable embodiment, the movement of the tines 36, 38 into and out of engagement with the switching mechanism is guided by an arcuate groove 40 in the second platform 46 and centered on axis A. In a more preferred embodiment, the arcuate groove 40 is in the shape of an unclosed circle.

The switching mechanism 42 toggles between its first and second positions in response to respective engagement by a first pin 28 or a second pin 30. The first pin 28 and second pin 30 are integrated into one of the plurality of claws 18. More preferably, the first and second pins 28, 30 are integrated into the gear portion 24 of one of the plurality of claws 18.

Figure 3:
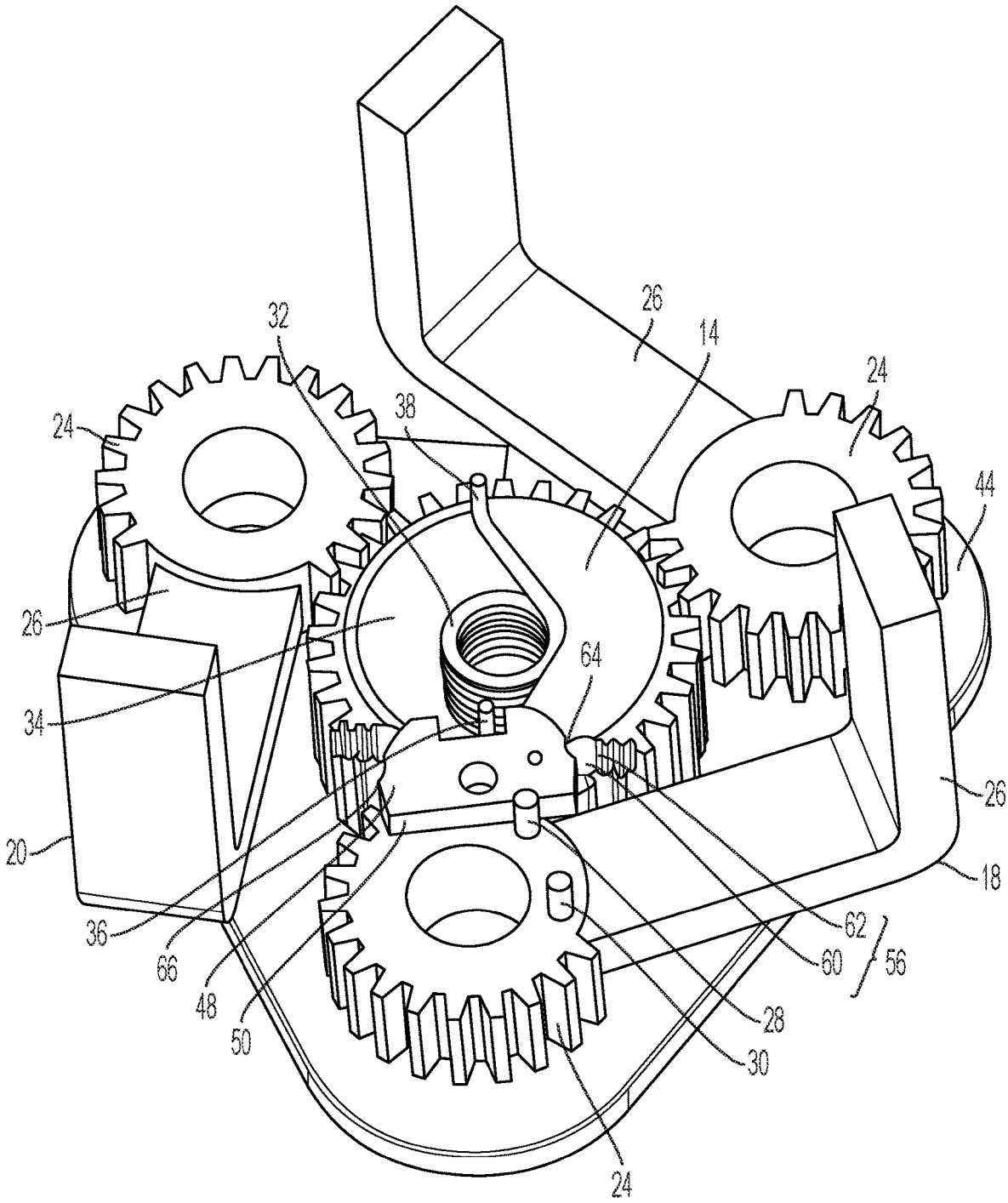
FIG. 3 perspective view of the oil filter wrench with part of the base removed and showing the internal gears and switching mechanism.
Figure 4:
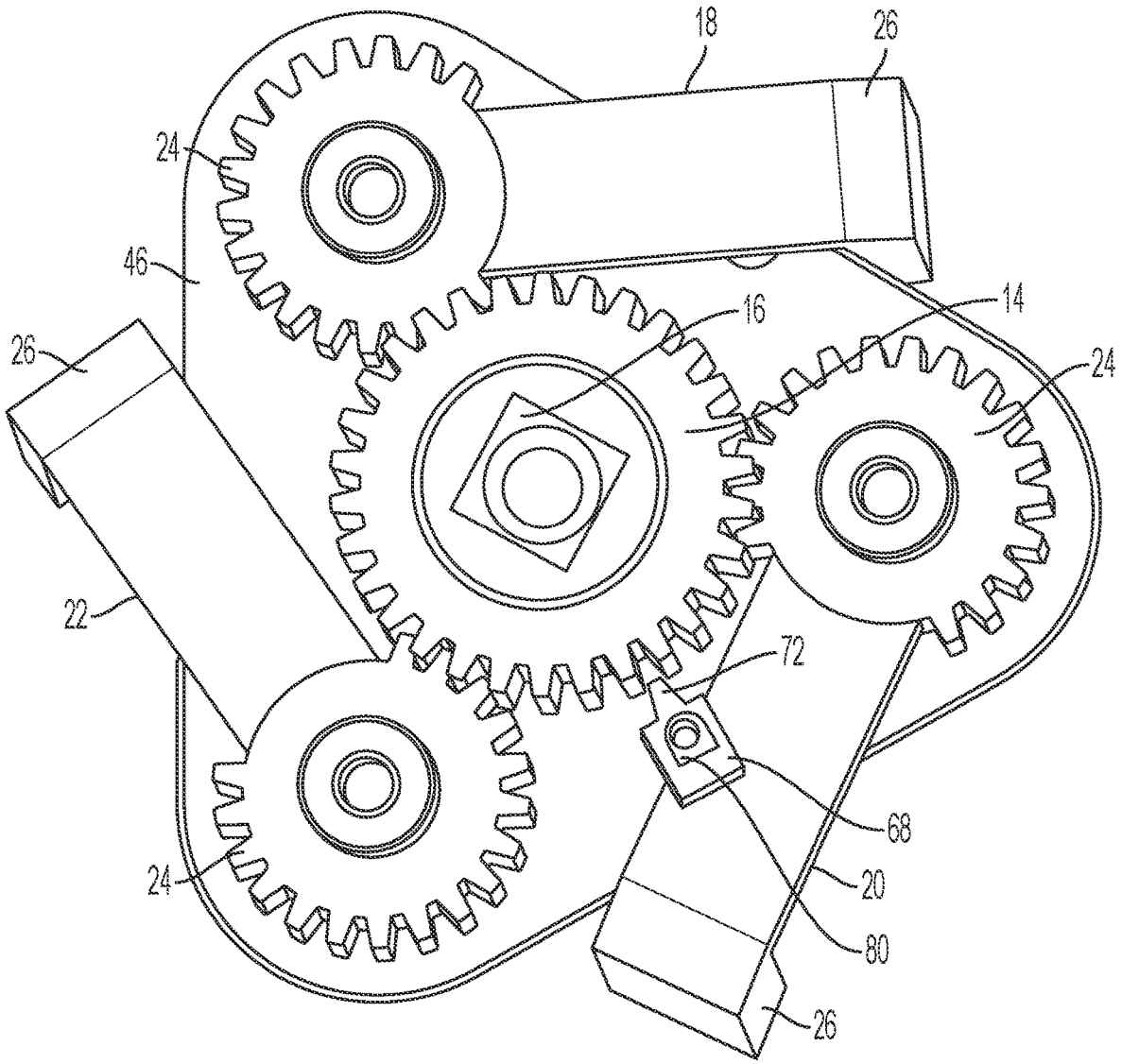
FIG. 4 is a perspective view of the oil filter wrench with another part of the base removed and showing the internal gears and part of the holding mechanism.
Figure 5:
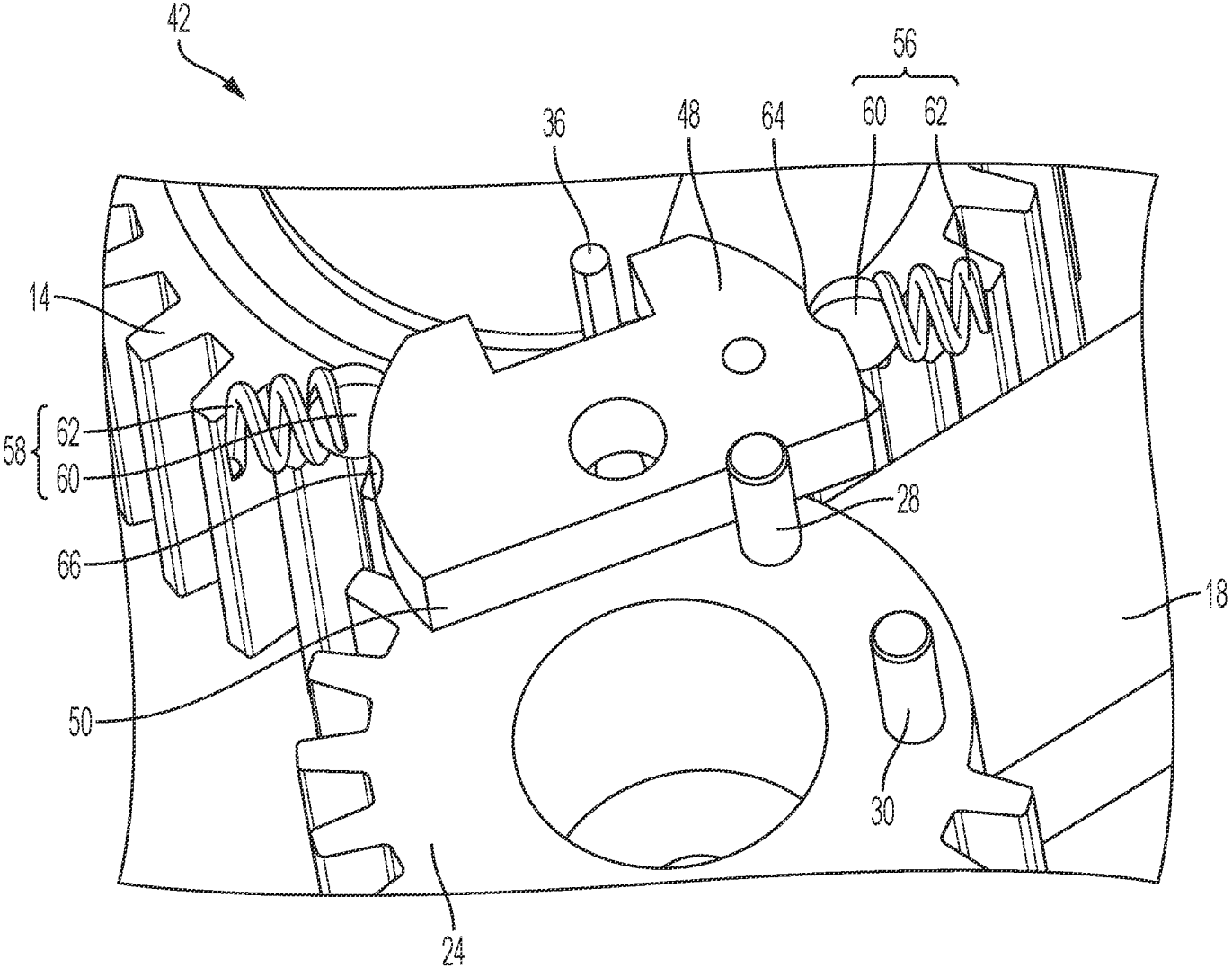
FIG. 5 is a detailed view of the switching mechanism.

As best seen in FIGS. 3 and 5, the switching mechanism 42 is rotatably disposed within the base 12. More specifically, the switching mechanism 42 is disposed within a switching cavity 86 of the second platform 46. The switching mechanism 42 includes a switch 48 is positioned on a switch protrusion 88 in the switch cavity 86. The switch 48 defines a small cavity 90 configured to receive the switch protrusion 88. The switch protrusion 88 guides and facilitates the rotational movement of the switch 48 within the switch cavity 86. Switch 48 includes a pin engaging surface 50 and a tine engaging surface 52. As expected, the pin engaging surface 50 is configured to selectively engage first pin 28 and second pin 30. Conversely, the tine engaging surface 52 is configured to selectively engage first tine 36 and second tine 38. In a preferred embodiment, the tine engaging surface 52 includes a U-shaped 54 carveout and is positioned on the side of the switch 48 opposite to that of the pin engaging surface 50.

The switching mechanism 42 may also include a first detent mechanism 56 and a second detent mechanism 58. The detent mechanisms 56, 58 are configured to engage the switch 48 and respectively hold it in the selected first or second position. These detent mechanisms 56, 58 may each contain a ball 60 and a spring 62. The detent mechanisms 56, 58 may respectively be disposed within cavities 74, 76 defined by the second platform 46. The ball 60 and the spring 62 are positioned within the cavities 74, 76 so that the ball 60 is biased toward the switch 48. In a preferred embodiment, the switch 48 includes a first notch 64 and a second notch 66. Notches 64, 66 are configured to receive the balls 60 of the respective first and second detent mechanisms 56, 58. For example, as best seen in FIGS. 3 and 5, when the switch 48 is in its first position, the first detent mechanism 56, and more specifically, the ball 60 of the first detent mechanism is engaged to the first notch 64 of the switch 48. Conversely, when the switch 48 is in its second position (not shown) the ball 60 of the second detent mechanism 58 is engaged to the second notch 66 of the switch 48.

In a preferred embodiment, the oil filter wrench 10 may also have a holding mechanism 68 that is selectively movable between a disengaged position and an engaged position. In the disengaged position, the holding mechanism is not engaged to the main gear 14. In the engaged position, the holding mechanism 68 is engaged to the main gear 14 such that the main gear 14 is held in a selected fixed position and cannot rotate in either the first direction or second direction. Preferably, the holding mechanism 68 includes two parts, a base 69 and a slide 70. The base 69 includes a gear protrusion 72 that is configured to engage the teeth 15 of the main gear 14. The slide 70 may be positioned in a cavity 78 defined by first platform 44 of the base 12. As best seen in FIG. 9, the holding mechanism 68 may further include a slide protrusion 80 that is configured to engage a corresponding depression (not shown) in the slide 70. In this way, the two-part holding mechanism can be assembled into the oil filter wrench 10 as shown in FIGS. 1-2.

INDUSTRIAL APPLICABILITY

Oil filters are often positioned within an engine, such that their removal/installation requires an oil filter wrench to be positioned at an odd angle wherein gravity causes the oil filter wrench to shift before a mechanic can begin to apply torque to remove/install the oil filter. In these instances, the mechanic often needs two hands to position the wrench on the oil filter and begin the torque application. Unfortunately, engine bays often do not have enough room to accommodate both of the mechanic's hands. In these instances, it would be preferable to have an oil filter wrench that can be manipulated and operated with one hand.

Figure 6C:
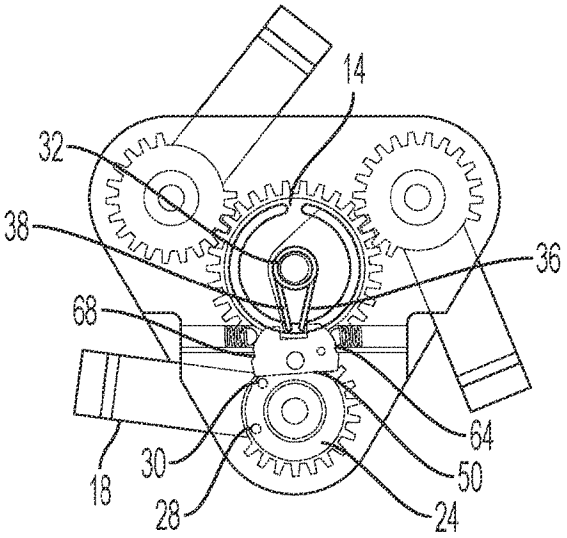

The operation of the oil filter wrench will now be explained. For purposes of this description, we will imagine that the used oil filter is attached to the engine and needs to be removed. FIG. 6*a* depicts an oil filter wrench 10 according to the present invention wherein the second platform 46 has been removed to show the main gear 14, claws 18, 20, 22 and switching mechanism 42. The first pin 28 is in contact with the pin engaging surface 50 of the switch 48. The switch 48 is in its first position. The switch 48 is held in this first position by the first detent mechanism 56, which is engaged to notch 64 of the switch. In this position, the first tine 36 of the main spring 32 is in contact with the U-shaped carveout 54 of the tine engaging surface 52 of the switch 48. The spring 32 is thus biasing the main gear towards rotation in the first direction. In this instance, said first direction is clockwise (CW). As the main gear rotates in the first direction, the gear portions 24 of claws 18, 20, 22 are correspondingly rotated in the counterclockwise (CCW) direction. Thus, the arms 26 are all moved to their retracted CCW position. The position is called "retracted CCW" because the arms are adjacent to the base 12 and the claws are biased in the CCW direction. In this retracted CCW position, the oil filter wrench 10 can be attached to an oil filter and the biased claws 18, 20, 22 will hold the oil filter wrench in place without further assistance from the mechanic. When the claws are in their retracted CCW position, the oil filter wench can be used to apply torque to an oil filter in a clockwise or tightening manner.

Figure 6B:
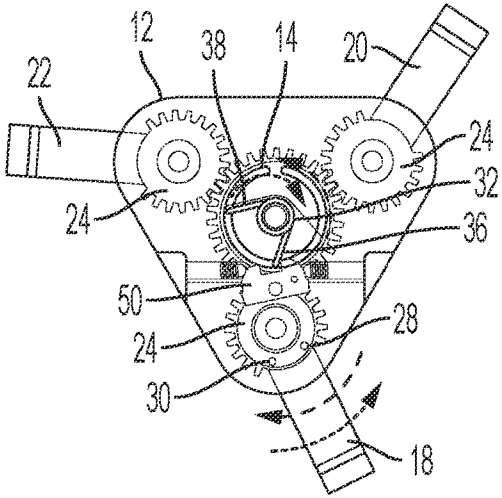
Figure 6A:
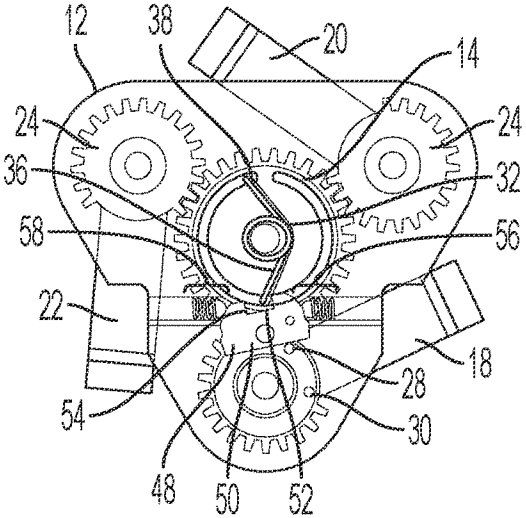
Figure 6E:
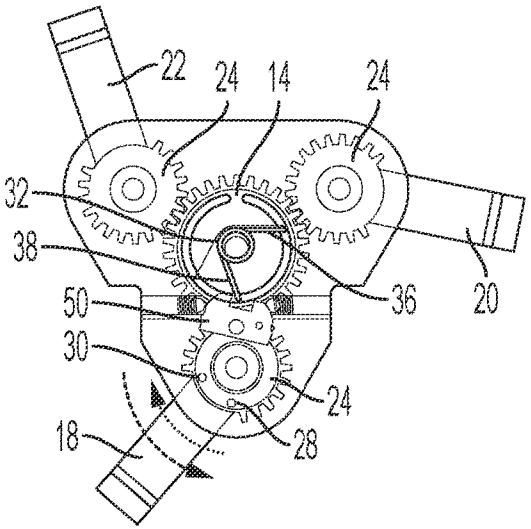

FIG. 6*b* shows the oil filter wrench 10 in its extended CCW position. In operation, a mechanic will move one or more claws 18, 20, 22 away from the base 12. In so doing, the gear portions 24 of the claws are briefly rotated in a CW direction, which causes the main gear 14 to rotate in its second direction (CCW). However, because the switch 48 is still in its first position and tine 36 is still in contact with the U-shaped carveout of the tine engaging portion 52, the rotation of the main gear 14 in the second direction (CCW) causes energy to be loaded into main spring 32. If the mechanic were to remove the force applied to move the claws from the their retracted CCW position to the extended CCW position, the energy loaded into main spring 32 would be also be released. The main spring 32 would thus rotate the main gear 14 in its first direction (CW) and subsequently cause the claws 18, 20, 22 to return to their retracted CCW position (See FIG. 6*a*). This automatic biasing of the claws toward their retracted CCW position is particularly useful because it allows a mechanic to position the oil filter wrench on an oil filter using but one hand. Thus, the mechanic can position the oil filter wrench on an oil filter remove his hand to obtain a torque applying handle and then position said torque applying handle on the drive portion 16 at her leisure.

Figure 6D:
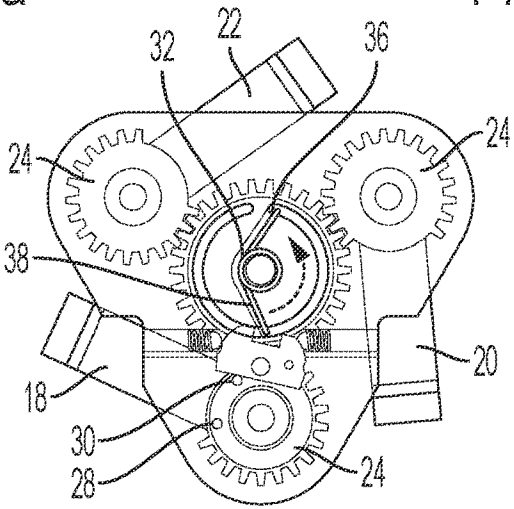

When a mechanic wishes to use the oil filter wrench in order to loosen an oil filter, it will first be necessary to toggle the switch to its second position. This is achieved by rotating the first claw 18 such that the second pin 30 comes into contact with the pin engaging surface 50. As best shown in FIG. 6*c*, continuing to rotate the first claw 18 in the CW direction, will cause the second pin 30 to apply enough force to the pin engaging surface 50 to make the switch 48 overcome its engagement with the first detent mechanism 56 and rotate to its second position wherein the second detent mechanism comes into contact with the notch 68 of the switch 48. FIG. 6*c* shows the switch 48 as it is transitioning from its first position to the second position. In this transition, the spring 32 has been coiled to the point where both the second tine 38 is proximal to the first tine 36. In FIG. 6*d*, the switch 48 has completed its transition from the first position to the second position. The ball 60 of the second detent mechanism 58 has come into contact with notch 68. When this happens, second tine 38 comes into contact with the U-shaped carveout 54. The first tine 36, which is no longer in contact with the U-shaped carveout, now releases its energy and biases the main gear 14 toward rotation in the second direction (CCW). The CCW rotation of the main gear 14 in turn causes the gear portions 24 of the claws 18, 20, 22 to rotate in the CW direction until the arms 26 of the claws reach their retracted CW position. (See FIG. 6*d*). The position is called "retracted CW" because the arms are adjacent to the base 12 and the claws are biased in the CW direction. In this retracted CW position, the oil filter wrench 10 can be attached to an oil filter and the biased claws 18, 20, 22 will hold the oil filter wrench in place without further assistance from the mechanic.

FIG. 6*d* shows the oil filter wrench 10 in its extended CW position. In operation, a mechanic will move one or more claws 18, 20, 22 away from the base 12. In so doing, the gear portions 24 of the claws are briefly rotated in a CCW direction, which causes the main gear 14 to rotate in its second direction (CCW). However, because the switch 48 is still in its second position and second tine 38 is still in contact with the U-shaped carveout 54 of the tine engaging portion 52, the rotation of the main gear 14 in the first direction (CW) causes energy to be loaded into main spring 32. If the mechanic were to remove the force applied to move the claws from their retracted CW position to the extended CW position, the energy loaded into main spring 32 would be also be released. The main spring 32 would thus rotate the main gear 14 in its second direction (CCW) and subsequently cause the claws 18, 20, 22 to return to their retracted CW position (See FIG. 6*d*). This automatic biasing of the claws toward their retracted CW position is particularly useful because it allows a mechanic to position the oil filter wrench on an oil filter using but one hand. Thus, the mechanic can position the oil filter wrench on an oil filter remove his hand to obtain a torque applying handle and then position said torque applying handle on the drive portion 16 at her leisure.

The oil filter wrench 10 of the present invention may also include a holding mechanism 68 that can be toggled between a disengaged position and an engaged position. In the disengaged position, the holding mechanism is disengaged from the main gear 14, and in the engaged position, the holding mechanism 68 is engaged to the main gear 14 and prevents its rotation in either the first or second direction. In a preferred embodiment, the holding mechanism 68 comprises a base portion 69 and a slide 70. The base portion 69 includes a protrusion 72 that is configured to engage the teeth 15 of the main gear 14. The slide 70 allows a mechanic to toggle the holding mechanism between its disengaged and engaged positions.

Depending on the desired use (i.e., tightening or loosening an oil filter), a mechanic may selectively position the claws of the oil filter wrench 10 into its extended CCW or extended CW position. (Those skilled in the art will recognize that the position of the claws in both the extended CCW and extended CW position may be identical. However, depending on the position of the switch 48, the claws will be biased toward retraction in different directions.) Once the claws are in the an extended CCW or extended CW position, the mechanic may toggle the holding mechanism toward its engaged position. This will prevent the rotation of the main gear 14 and thereby prevent the claws from automatically moving toward their respective retracted CCW or retracted CW positions. Making use of the holding mechanism in this way is useful because it will allow the mechanic to test the size of the oil filter that is to be removed. By holding the claws in one of their myriad extended positions, she can easily determine whether she had made the expanse across the oil filter wrench 10 to be large enough for the intended use. Thereafter, she can adjust the expanse accordingly. Alternatively, she may simply open the claws to their widest possible expanse and set the holding mechanism 68 to its engaged position. Once she has the oil filter wrench in position around an oil filter, she may toggle the holding mechanism 68 to its disengaged position, thereby allowing the biased rotation of the main gear 14 to automatically move the claws 18, 20, 22 into engagement with the oil filter to be replaced or installed. In an alternate embodiment, the holding mechanism 68 can also be configured be movable between a disengaged position and an engaged position, wherein in the engaged position, the holding mechanism prevents rotational movement of one of the gear portions 24 of the claws 18, 20, 24.

Once the oil filter wrench 10 of the present invention is positioned on an oil filter to be replaced or installed, a mechanic may engage a ratchet or other tool to the drive portion 16 of the main gear 14. Preferably, the ratchet will include a male driver to be received by the female drive portion 16. Once in position, the mechanic can apply rotational torque to the main gear 14, which will rotate the claws into tightening engagement with the oil filter. As she continues to apply rotational torque to the handle, she may either tighten or loosen the oil filter depending on her desired action and the corresponding positioning of the switch 48.

Although aspects of the invention have been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

The invention claimed is:

1. An oil filter wrench (10) comprising:

a base (12) having an axis (A);

a main gear (14) centered on the axis and rotatably disposed within the base (12), and wherein said main gear (14) further includes a drive portion (16) accessible from outside the base (12);

a plurality of claws (18, 20, 22) each having a gear portion (24) and an arm (26) configured to engage an oil filter, and wherein the gear portions (24) are rotatably disposed within the base (12) and configured to engage the main gear (14) such that when the main gear (14) rotates, the arms (26) correspondingly extend or contract relative to the base (12);

a main spring (32) disposed within a cavity (34) defined by the main gear (14) and configured to selectively bias the main gear (14) toward rotation in either a first direction or a second direction opposite to the first direction; and characterized in that the oil filter wrench (10) further includes a switching mechanism (42) configured to selectively toggle between a first position and a second position, wherein in said first position, the switching mechanism (42) engages a first tine (36) of the main spring (32) such that the main gear (14) is biased to rotate in the first direction, and wherein in said second position, the switching mechanism (42) engages a second tine (38) of the main spring (32) such that the main gear (14) is biased to rotate in the second direction, and wherein the switching mechanism (42) is toggled between the first and second positions by respectively engaging a first pin (28) or a second pin (30) that is integrated into one of the plurality of claws (18).

2. The oil filter wrench (10) of claim 1, wherein the switching mechanism (42) is rotatably disposed in the base (12) and comprises a switch (48) having a pin engaging surface (50) and a tine engaging surface (52).

3. The oil filter wrench (10) of claim 2, wherein the tine engaging surface (52) of the switch (48) includes a U-shaped carveout (54) and is positioned on the side of the switch 48 that is opposite to the pin engaging surface (50).

4. The oil filter wrench (10) of claim 2, wherein the switching mechanism (42) further includes a first detent mechanism (56) and a second detent mechanism (58), and wherein each is configured to engage the switch (48) and respectively hold the switch (48) in the selected first or second position.

5. The oil filter wrench (10) of claim 4, wherein the first detent mechanism (56) and the second detent mechanism (58) each comprise a ball (60) and spring (62), and wherein said springs (62) bias said balls (60) toward the switch (48).

6. The oil filter wrench (10) of claim 2, wherein the switch (48) further includes a first notch (64) and a second notch (66) that are respectively configured to receive the balls (60) of the first detent mechanism (56) or the second detent mechanisms (58).

7. The oil filter wrench (10) of claim 2, further comprising a holding mechanism (68) that is engageable from outside of the base (12) and is selectively movable between a disengaged position and an engaged position, wherein in said disengaged position, the holding mechanism (68) is not engaged to the main gear (14), and wherein in said engaged position, the holding mechanism (68) is engaged to the main gear (14) such that the main gear (14) is held in a selected fixed position and cannot rotate in either the first direction or the second direction.

8. The oil filter wrench (10) of claim 7, wherein the holding mechanism (68) comprises a base portion (69) and a slide (70), and wherein the base portion (69) includes a protrusion (72) configured to selectively engage the main gear (14), and wherein the slide (70) is configured to connect to the base portion (69) and control the movement of the holding mechanism (68) between the disengaged position and the engaged position.

9. The oil filter wrench (10) of claim 2, wherein the plurality of claws are three claws (18, 20, 22).

10. The oil filter wrench (10) of claim 2, wherein the arm of each of the plurality of claws is L-shaped.

11. The oil filter wrench (10) of claim 2, wherein the base (12) is comprised of a first platform (44) and second platform (46).

12. The oil filter wrench (10) of claim 11, wherein the second platform 46 includes an unclosed circular groove (40) centered about axis (A) and configured to receive and guide the movement of the first and second tines (36, 38).

13. The oil filter wrench (10) of claim 12, wherein the second platform (46) further includes a cavity for housing the switch, and cavities (74, 76) for housing each of the first and second detent mechanisms (56, 58).

14. The oil filter wrench of claim 12, wherein the second platform (46) further includes a main gear protrusion (82), a switch protrusion (88), and claw protrusions (84) for each of the plurality of claws, and wherein each protrusion is configured to engage its respective element and guide rotational movement thereof.

15. The oil filter wrench (10) of claim 11, wherein the second platform (46) further includes a cavity for housing the switch, and cavities (74, 76) for housing each of the first and second detent mechanisms (56, 58).

16. The oil filter wrench of claim 11, wherein the second platform (46) further includes a main gear protrusion (82), a switch protrusion (88), and claw protrusions (84) for each of the plurality of claws, and wherein each protrusion is configured to engage its respective element and guide rotational movement thereof.

17. The oil filter wrench (10) of claim 2, wherein the drive portion (16) is configured to receive a tool and impart rotational torque to the main gear (14).

* * * * *